US007056223B2

(12) United States Patent
Wohldorf

(10) Patent No.: US 7,056,223 B2
(45) Date of Patent: Jun. 6, 2006

(54) METHOD FOR PRODUCING GOLF CLUBS THAT ARE INDIVIDUALLY ADAPTED TO THE RESPECTIVE HEIGHT OF GOLF PLAYERS

(75) Inventor: Peter A. W. Wohldorf, Kaltenkirchen (DE)

(73) Assignee: WOHLDORF GmbH, Kaltenkirchen (DE)

( * ) Notice: Subject to any disclaimer, the term of this patent is extended or adjusted under 35 U.S.C. 154(b) by 0 days.

(21) Appl. No.: 10/505,581

(22) PCT Filed: Feb. 26, 2002

(86) PCT No.: PCT/EP02/02046

§ 371 (c)(1),
(2), (4) Date: Oct. 14, 2004

(87) PCT Pub. No.: WO03/072203

PCT Pub. Date: Sep. 4, 2003

(65) Prior Publication Data

US 2005/0070369 A1 Mar. 31, 2005

(51) Int. Cl.
*A63B 69/36* (2006.01)

(52) U.S. Cl. ..... 473/257; 473/409

(58) Field of Classification Search ..... 473/237, 473/244, 245, 246, 248, 252, 253, 257, 409; 33/508

See application file for complete search history.

(56) References Cited

U.S. PATENT DOCUMENTS

| | | | | |
|---|---|---|---|---|
| 4,104,802 | A * | 8/1978 | Johnston | 33/508 |
| 4,932,662 | A * | 6/1990 | Blaisdell | 473/237 |
| 5,609,530 | A * | 3/1997 | Butler, Jr. | 473/237 |
| 5,911,636 | A * | 6/1999 | Schmoll | 473/266 |
| 6,041,651 | A * | 3/2000 | Naruo et al. | 73/491 |
| 6,102,811 | A | 8/2000 | Henry | |
| 6,405,450 | B1 * | 6/2002 | Wood et al. | 33/759 |
| 6,779,277 | B1 * | 8/2004 | Sones | 33/508 |
| 6,793,587 | B1 * | 9/2004 | Llewellyn et al. | 473/242 |

* cited by examiner

*Primary Examiner*—Nini F. Legesse
(74) *Attorney, Agent, or Firm*—Dykema Gossett PLLC

(57) ABSTRACT

The invention relates to a method for producing golf clubs that are individually adapted to the respective height of golf players. According to the invention, a test person firstly executes, with a test club whose distance from the floor (H) corresponds to the distance of the wrist of the upright-standing test person from the floor, one or more test strokes on a specially prepared flat base. Afterwards, the line of contact of the bottom (5) of the test club head (1) with the base is determined, and the distance of the line of contact from the club head central plane (0) is measured. The length (L) of the shaft (2) is subsequently adapted according to this measured distance. The invention also relates to a template and a chart.

3 Claims, 3 Drawing Sheets

4a

4b

4c

METHOD FOR PRODUCING GOLF CLUBS THAT ARE INDIVIDUALLY ADAPTED TO THE RESPECTIVE HEIGHT OF GOLF PLAYERS

BACKGROUND OF THE INVENTION

1. Field of the Invention

The invention involves a method for manufacturing golf clubs which are individually fitted to the user.

2. The Prior Art

Nowadays, golf clubs are fitted on demand according to the physical characteristics of a player, and, in fact not only in a static way, in which a test club is stood up on the floor and the shaft length as well as the angle between the clubhead and the shaft, the so-called lie angle, is measured according to the size of the golfer, but also in a dynamic way, by considering the swing action while hitting the golf ball. A golf club is said to be fitting if the sole of the clubhead touches the ground exactly in the middle at the moment of impact. If this is the case, the club neither turns to the right nor to the left, which would inevitably be the case with contact with the ground that is not in the middle.

Since a complete set includes 14 golf clubs, which all have different set angles for the face of the club (generally called "loft angle" or "loft" in short), it would theoretically be practical to manufacture all the golf clubs in the set in such a customized way that each club makes contact with the ground in the middle. However, it has been determined that it is considerably more important to adjust the short irons so that they fit exactly, while this does not seem to be so important for the long irons and the woods. Among the short irons are clubs such as the sand wedge (SW) with a loft of 55' for instance, the pitching wedge with a loft of 48° for instance, the 9 iron with a loft of 44° for instance, and the 8 iron with a loft of 39° for instance. The so-called middle irons, the 7 to 5 irons, have a loft angle accordingly of 35° to 27° for instance, while the long irons, the 4 to 1 irons, can have a loft of 24° to 16° for instance.

It is now known that there are two methods of carrying out individual fitting. The static fitting method is the older of the two; it is generally called "static lie fitting" worldwide. The younger and thereby more modern dynamic method, which represents the state of the art today, is called "dynamic lie fitting." With the latter method a golfer hits several golf balls for this purpose from a specially prepared surface, a so-called hitting board or "lie test hitting board." This is a board that is approximately 1–3 cm thick, usually made of wood with the dimensions of 1 m×1 m. It should be measured so that a player can stand on the board and carry out the test shots. In order to provide the sole of the clubhead with a contact marking, a marked area is normally worked into the board, which shows a layer of color, for example graphite, and provides the sole of the clubhead with a colored marking for a shot that is made correctly, which represents the contact line of the sole with the hitting board.

Until now clubmakers have proceeded in such a way that if the contact line does not correspond with the middle of the sole, which is normally the case, then the angle between the shaft and the sole, which is called the "lie angle" ($\alpha$), is altered by using a loft and lie machine to bend the angle, until the contact line is approximately congruent with the middle of the sole after repeated test shots.

A disadvantage of this "dynamic lie fitting method" is that not all golf clubs can be bent. In order to change the lie angle ($\alpha$), the loft and lie machine must be applied to the head of the club and thereby change the angle between the head and the shaft neck, which, however, is only possible with forged clubs. Golf clubs that are cast cannot be bent because the material does not have the necessary elasticity and simply would break.

It is therefore the task of the invention to create an improved dynamic manufacturing method through which golf clubs, which are forged as well as cast or manufactured in another way, can be produced with an individual fit.

With this method practically all golf clubs can be manufactured with an optimal fit, regardless whether they are for men, women or children, and also in terms of the golfer's dynamic swing action. This is the case if the club length is properly fitted to the existing lie angle by taking into consideration the bending of the shaft at the moment of impact, the so-called "toe down bending," so that the sole of the clubhead touches the ground exactly in the middle at the moment of impact and the clubhead does not twist at the moment of impact.

The stencil method makes previous fitting methods superfluous, i.e. changing the lie angle through bending while retaining the shaft length, because a set of clubs with the correct shaft length can now be manufactured for the user for the first time without changing the lie. Additionally the bending of the shaft during the shot is taken into consideration for the first time by analyzing the test shot with the help of a stencil. This bending apparently cannot be calculated, but only determined experimentally. The stencil method allows one to consider the bending that is experimentally determined through the test shot, which is marked on the sole of the clubhead; and the manufacturing of golf clubs that are fitted from the start.

In the first step the golf club manufacturer produces a group of test clubs with the same loft, however, with a different distance to the floor H (called "wrist-to-floor" (W-t-F)), for example the 9 iron (loft=44°; lie=64°) with W-t-F of 23" to 38", whereby the measurements are provided worldwide in inches ["] and independent of the usual system of measurement of Sl units in Europe [mm or cm]. Now it is not necessary to manufacture the test clubs in all sizes from 1", for example 16 clubs for the 9 iron with the W-t-Fs of 23", 24" . . . 38". It suffices if only those clubs are delivered, as they would approximately fit the customer waiting for the clubs, e.g. the 9 iron with W-f-Ts of 29", 31", 33" and 35".

It should be pointed out that it suffices if a golfers carries out the fitting based on a single test club, e.g. with a club type like the 9 iron with a distance to the floor (wrist-to-floor) that approximately fits, because if a club is correctly fitted then all the other clubs in the same set of clubs will fit, which also means the sand wedge (SW), the pitching wedge (PW), and the 8 to 1 irons.

In the second step a stencil is produced for a set of test clubs which indicates how far the contact point of the club sole is not aligned in the middle at the moment of impact with the ground, if one and the same person carries out a shot, for example, on a hitting board with golf clubs that have the same loft and lie angles, however, other wrist-to-floor distances.

In the third step the distance between the test person's wrist and the floor is measured in a vertical direction, which means the distance to the floor H (or wrist-to-floor (W-t-F)), and the best possible test club is selected.

In the fourth step the test person carries out a few shots on a hitting board with the test club that has already been chosen.

In the fifth step the club manufacturer takes the stencil that was produces according to the second step, holds it to the sole of the test club, and reads where the contact point, or the contact line, is located in terms of the middle of the sole.

In the sixth step the club manufacturer reads from the chart how long the club should be by taking into consideration the correction that was determined through the stencil and then cuts the shaft to the correct length.

In the seventh step only the grip has to be placed on the end of the shaft in the normal way.

The invention is explained below in detail based on the attached drawings.

DETAILED DESCRIPTION

Figure 1:
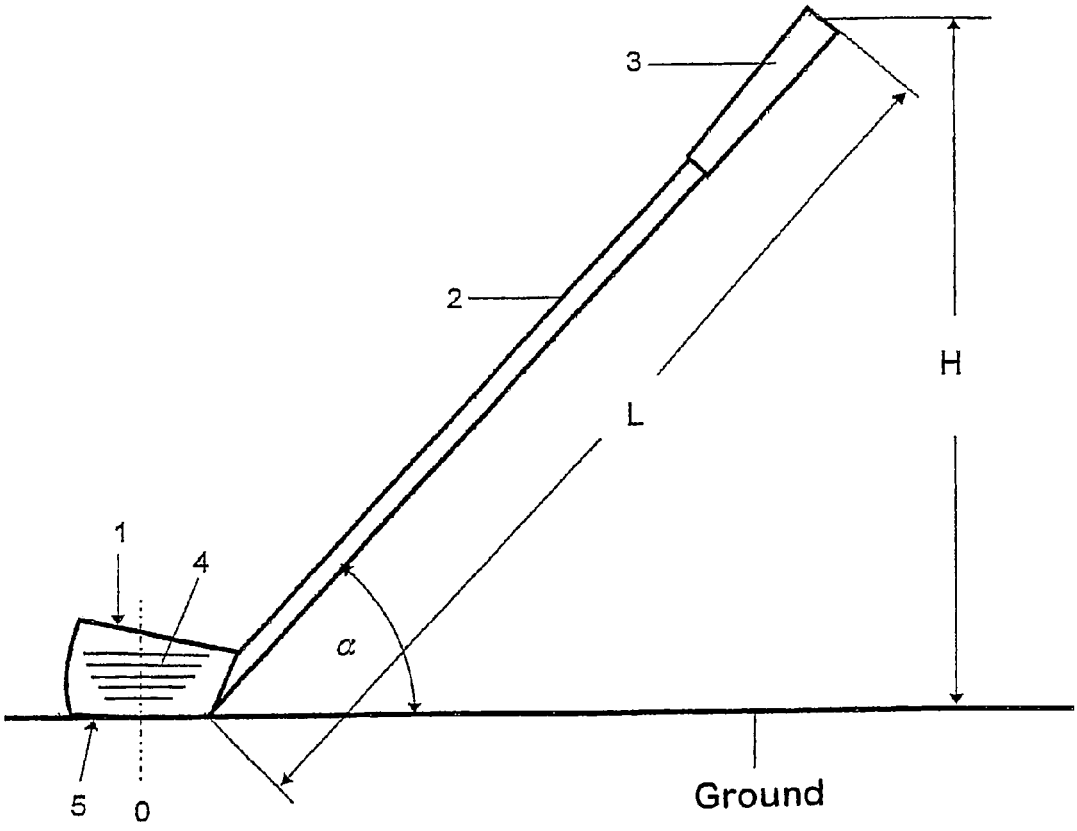
FIG. 1 the schematic depiction of a golf club.

FIG. 1 illustrates a gold club with a clubhead 1, a shaft 2 attached to it, and a grip 3. The grip 3 is attached to the end of the shaft 2 from which the clubhead 1 has been removed.

The clubhead 1 has a face 4 which forms a so-called loft angle β with one of the vertical planes that corresponds to the plane in the drawing. Usually the loft can extend from 10° to about 60°. More details are provided in the chart below. Contact with the ground takes place at the moment of impact with the sole 5, whereby contact is supposed to take place in the middle corresponding to the line 0 so that no moment of rotation can occur which would twist the clubhead 1 to the right or left.

The angle α, which the shaft forms with the ground, is the so-called lie angle which has been assigned to individual clubs in a set based on long-year experience. The following chart shows an example of this; however, it should be pointed out that other lie angles can also be assigned to the respective club. For example, a 9 iron does not necessarily have to have a lie α=64°; it could also be one or two degrees less, depending on how the manufacturer wants to make the set of clubs.

If a golf club with a certain lie angle is now placed on the ground so that its sole 5 rests in the middle, then according to FIG. 1 this results in a distance to the ground H which is measured from the free end of the grip 3 to the ground, approximately corresponding to the wrists of the player holding the grip 3 to the ground, so that H can also be called "wrist-to-floor" (W-t-F).

In addition, club length L shown in FIG. 1 is measured from the end of the grip 3 to the point of contact with the ground. This results in the correlation:

$$\text{sine } \alpha = H/L$$

or $$L = H/\text{sine } \alpha$$

Chart 1 below shows these calculated values for four "floor-to-wrist" values.

CHART 1

| Iron No. | Loft° | Lie° | H | 35 | 34.5 | 34 | 33.5 |
|---|---|---|---|---|---|---|---|
| 1 | 16 | 56 | L = | 42.2 | 41.6 | 41.0 | 40.4 |
| 2 | 18 | 57 | L = | 41.7 | 41.1 | 40.5 | 39.9 |
| 3 | 21 | 58 | L = | 41.3 | 40.7 | 40.1 | 39.5 |
| 4 | 24 | 59 | L = | 40.8 | 40.2 | 39.7 | 39.1 |

CHART 1-continued

| Iron No. | Loft° | Lie° | H | 35 | 34.5 | 34 | 33.5 |
|---|---|---|---|---|---|---|---|
| 5 | 27 | 60 | L = | 40.4 | 39.8 | 39.3 | 38.7 |
| 6 | 31 | 61 | L = | 40.0 | 39.4 | 38.9 | 38.3 |
| 7 | 35 | 62 | L = | 39.6 | 39.1 | 38.5 | 37.9 |
| 8 | 39 | 63 | L = | 39.3 | 38.7 | 38.2 | 37.6 |
| 9 | 44 | 64 | L = | 38.9 | 38.4 | 37.8 | 37.3 |
| SW/PW | 55 | 65 | L = | 38.6 | 38.1 | 37.5 | 37.0 |

The starting point for this is the normal lie angles of 56° to 65° for the 1–9 irons and the SW/PW. If a clubmaker select other lie angles for his sets of golf clubs, then the values in Chart 1 naturally change. However, basically nothing should change because the floor-to-wrist distances H are given in increments of ½ inches. Only those people could work with Chart 1 whose wrist-to-floor distance is between 33.5" and 35"; however, it is not difficult for an expert to extend the chart to values of H=23 to 38.

One arrives at Chart 2 if one provides the values in Chart 1 with a correction factor, namely by subtracting the constant factor A=2.5. This is because the wrist-to-floor distance of a player is reduced in respect to the initial upright position, with the arms hanging down close to the body, if the player is leaning slightly forward and his hands are holding the grip 3. Factor A is a practical value which is set appropriately at 2.5, however, could also include the range of 1.5–3.0.

CHART 2

| Iron No. | Loft° | Lie° | H | 35 | 34.5 | 34 | 33.5 |
|---|---|---|---|---|---|---|---|
| 1 | 16 | 56 | L1 = | 39.7 | 39.1 | 38.5 | 37.9 |
| 2 | 18 | 57 | L1 = | 39.2 | 38.6 | 38.0 | 37.4 |
| 3 | 21 | 58 | L1 = | 38.8 | 38.2 | 37.6 | 37.0 |
| 4 | 24 | 59 | L1 = | 38.3 | 37.7 | 37.2 | 36.6 |
| 5 | 27 | 60 | L1 = | 37.9 | 37.3 | 36.8 | 36.2 |
| 6 | 31 | 61 | L1 = | 37.5 | 36.9 | 36.4 | 35.8 |
| 7 | 35 | 62 | L1 = | 37.1 | 36.6 | 36.0 | 35.4 |
| 8 | 39 | 63 | L1 = | 36.8 | 36.2 | 35.7 | 35.1 |
| 9 | 44 | 64 | L1 = | 36.4 | 35.9 | 35.3 | 34.8 |
| SW/PW | 55 | 65 | L1 = | 36.1 | 35.6 | 35.0 | 34.5 |

Figure 3:
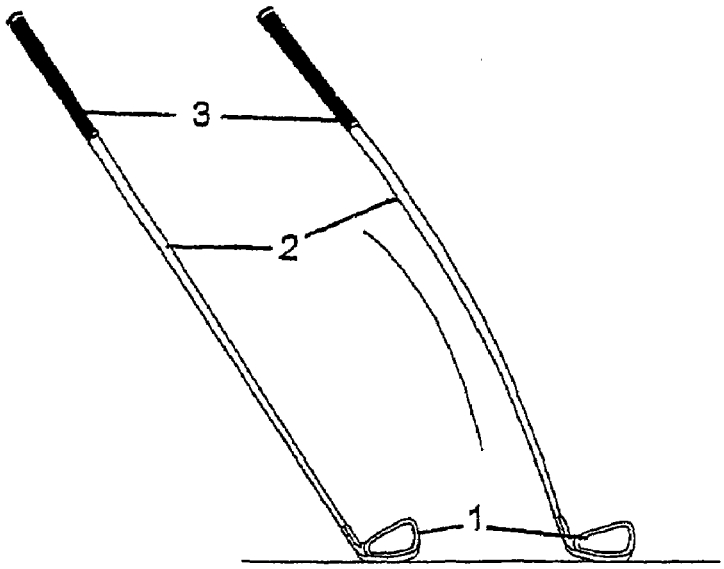
FIG. 3 a golf club during a shot.

Chart 3 is created from Chart 2 if one provides the length L1 with an additional correction factor, namely with factor B for the bending of the golf club shaft during the shot, which is the so called "toe down bending" that is shown in FIG. 3. The longer the club, the greater is correction factor B. It extends from 0.0 to 0.9 in increments of 0.1. Consequently, the values from Chart 2 for Chart 3 axe each increased by 0.1 for example, which means that for a 9 iron and a 35" club, the changes are from 36.4 to 36.5 etc.

CHART 3

| Iron No. | Loft° | Lie° | H | 35 | 34.5 | 34 | 33.5 |
|---|---|---|---|---|---|---|---|
| 1 | 16 | 56 | L2 = | 40.6 | 40.0 | 39.4 | 38.8 |
| 2 | 18 | 57 | L2 = | 40.0 | 39.4 | 38.8 | 38.2 |
| 3 | 21 | 58 | L2 = | 39.5 | 38.9 | 38.3 | 37.7 |
| 4 | 24 | 59 | L2 = | 38.9 | 38.3 | 37.8 | 37.2 |
| 5 | 27 | 60 | L2 = | 38.4 | 37.8 | 37.3 | 36.7 |
| 6 | 31 | 61 | L2 = | 37.9 | 37.3 | 36.8 | 36.2 |
| 7 | 35 | 62 | L2 = | 37.4 | 36.9 | 36.3 | 35.7 |
| 8 | 39 | 63 | L2 = | 37.0 | 36.4 | 35.9 | 35.3 |
| 9 | 44 | 64 | L2 = | 36.5 | 36.0 | 35.4 | 34.9 |
| SW/PW | 55 | 65 | L2 = | 36.1 | 35.6 | 35.0 | 34.5 |

Finally, one arrives at Chart 4 if the values from Chart 3 are evened off in increments of 0.5 which is best seen in column 34.5.

If we designate the distance wrist-to-floor as H, the club length as L3, and the lie angle as α, the following correlation is the result of the values in Chart 3:

$$L_3=(H/\text{sine } \alpha)-A+B$$

whereby A=2.5

B=n×0.1 and thereby

N=1,2, . . . 9.

The values determined from Chart 3 are then rounded off in Chart 4 in such a way that each degree of lie angle corresponds to an increment amount of 0.5.

CHART 4

| Iron No. | Loft° | Lie° | H | 35 | 34.5 | 34 | 33.5 |
|---|---|---|---|---|---|---|---|
| 1 | 16 | 56 | L3 = | 40.6 | 40.0 | 39.4 | 38.8 |
| 2 | 18 | 57 | L3 = | 40.1 | 39.5 | 38.9 | 38.3 |
| 3 | 21 | 58 | L3 = | 39.6 | 39.0 | 38.4 | 37.8 |
| 4 | 24 | 59 | L3 = | 39.1 | 38.5 | 37.9 | 37.3 |
| 5 | 27 | 60 | L3 = | 38.6 | 38.0 | 37.4 | 36.8 |
| 6 | 31 | 61 | L3 = | 38.1 | 37.5 | 36.9 | 36.3 |
| 7 | 35 | 62 | L3 = | 37.6 | 37.0 | 36.4 | 35.8 |
| 8 | 39 | 63 | L3 = | 37.1 | 36.5 | 35.9 | 35.3 |
| 9 | 44 | 64 | L3 = | 36.6 | 36.0 | 35.4 | 34.8 |
| SW | 55 | 65 | L3 = | 36.1 | 35.6 | 34.9 | 34.3 |

Figure 2:
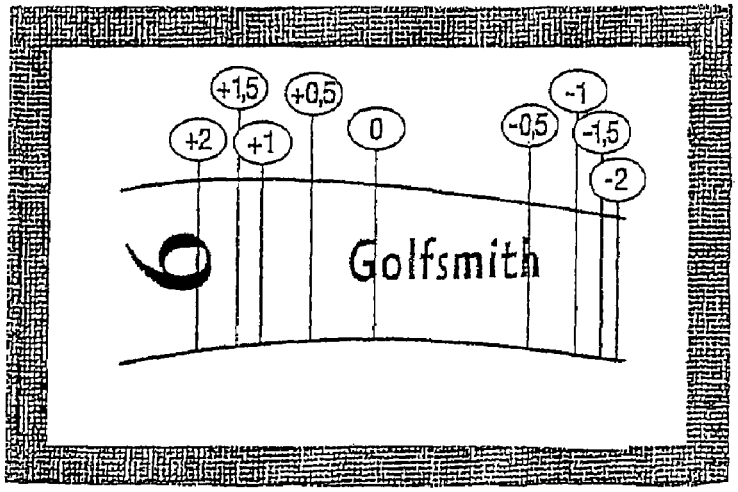
FIG. 2 the first stencil.

FIG. 2 shows a stencil which was made for a 9 iron and from which one can see how large the shift is in respect to the middle line, or zero line, of a golf club with a distance to the ground H or a wrist-to-floor of 24" in increments of +/−0.5. The reason for this shift is the curvature of the shaft 2 during the shot, as can be seen on the right side of FIG. 3, which leads to the toe down bending of the clubhead as has already been mentioned. If the test person hits the hitting board with the clubhead 1 in such a way that a contact line appears, which is found at +1 according to the stencil in FIG. 2, then the manufacturer has to switch from column 34 to column 35 in Chart 4 in order to determine the correct length L3, for the 9 iron. This means that instead of 35.4", the length 36.6" has to be selected, and the shaft 2 of the new club bas to be cut at 36.6" for a new clubhead 1 of the same type as the test club. Afterwards, the grip 3 is placed on the shaft and the individually fitted 9 iron is finished. The remaining clubs in the set are then completed according to column 35 from Chart 4 without any additional tests for information about the length.

Figure 4:
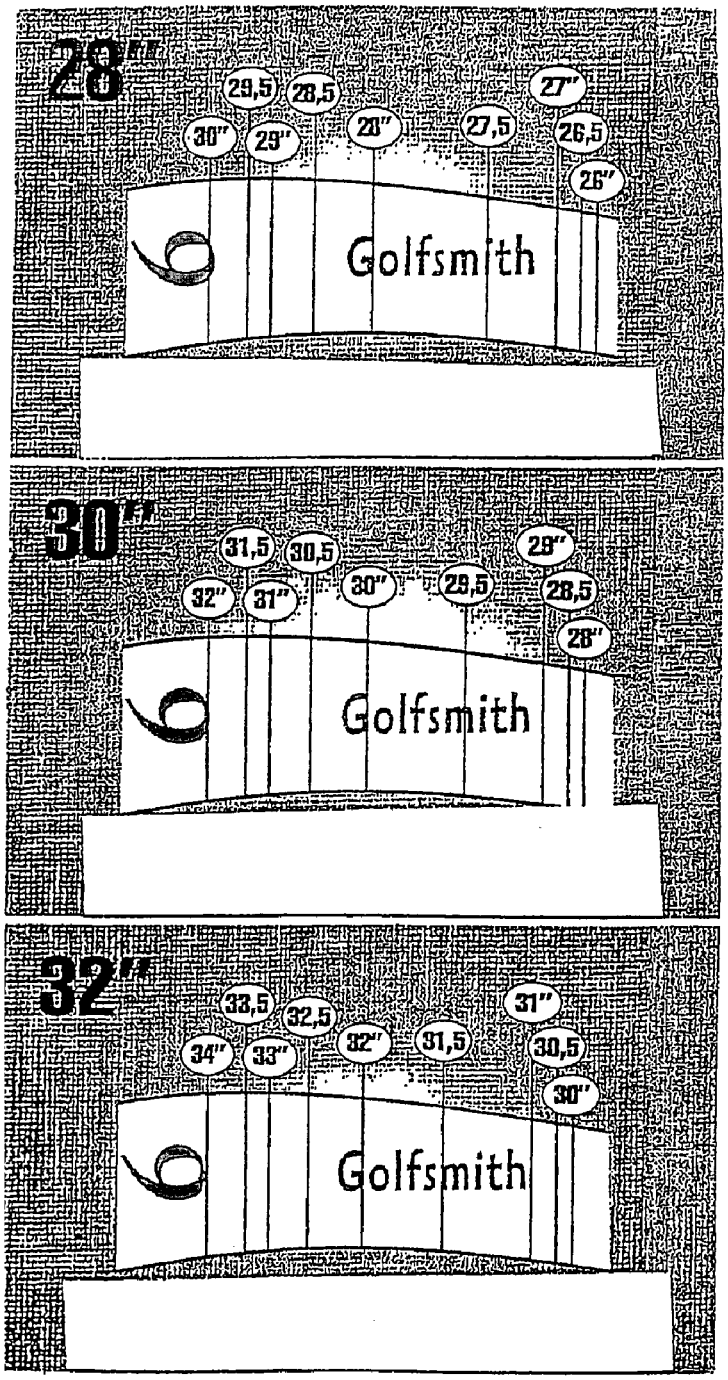
FIG. 4 three additional stencils.

FIG. 4*a–c* show three further stencils in which the contact lines for clubs with the same lie angle α are provided, but with a different distance to the wrist H and therefore with other wrist-to-floor values, which are not in distances of +/−0.5", but rather directly in wrist-to-floor values.

FIG. 4*a* shows a stencil for a 28" golf club of the same type as a 9 iron whereby the middle line is labeled 28", which according to the stencil in FIG. 2 is designated 0.

FIG. 4*b* shows a similar stencil as FIG. 4*a*, but for a 30" test club, while the stencil in FIG. 4*c* is intended for a 32" test club.

Now let us turn once again to a test person with a wrist-to-floor value of 32" for example: this person will select a 32" test club for the choice of an optimally fitting set of clubs, which is made from the same heads, shafts, and grips as the desired set of clubs. The test person carries out 1, 2 or more shots on the testing board with this test club. In the process, a marking appears on the sole 5 of the clubhead 1 which shows the point in which the sole 5 made contact with the testing board during the shot.

Afterwards, the clubmaker takes the stencil, in this case from FIG. 4*c* with the label 32", and places it in such a way on the sole 5 of the clubhead 1 that it exactly covers the grooves, which axe always found on the sole 5 such as the respective trademark and possibly the number of the clubhead, so that the stencil 32" is precisely aligned with the sole of the 32" test club of the same type as the 9 iron.

The marking on the sole 5, which results from the test shots and can be seen through the film-like stencil, often does not coincide with the middle line, which is indicated by the number 32" in an oval circle, but rather is next to it on the right or left. The vertical line closest to the marking is then the decisive line, and because of this line the clubmaker can read the number assigned to this line which is closest to the wrist-to-floor value of the test person. If this marking is between lines 33" and 33.5" on the stencil in FIG. 4*c* for instance, but closer to the 33.5" line, then this means that the test person would best hit with a set of clubs with a wrist-to-floor value of 33.5" since he would then generally make contact with an even hitting surface exactly in the middle of the sole 5 of the club with a set of such clubs.

If the above-mentioned example were applied, this would mean that the clubmaker would produce a set of clubs for the test person according to column 33.5 in Chart 4, which means the length L=34.8" for a 9 iron. The clubmaker can now use the same chart for the lengths of irons 1 to 8, which means from 38.8" to 35.3".

It should once again be pointed out that drawing up the charts is not a matter of invention because individual charts can be made for each type of club and clubhead. Furthermore, each club manufacturer can make their own charts for their products according to which they could manufacture their clubs. It is only important that a chart exists for each test club and that the correct wrist-to-floor value and thereby the correct column on the chart is selected depending on the shift of the contact line on the sole of the clubhead, which is measured by the stencil according to the invention.

The invention claimed is:

1. A method of making golf clubs individually fitted according to a body size of a golfer, each golf club having a shaft and a clubhead attached to a bottom end of the shaft, each clubhead having a striking face and a sole, the striking face forming a loft angle with a vertical plane extending through the shaft and the sole forming a lie angle α with the shaft, the method comprising the steps of:

producing a group of test clubs with the same loft and the same lie angle which are predetermined without reference to the golfer, the test clubs in the group having different grip heights above a floor;

providing stencils on the group of test clubs to indicate the contact point on the club sole at impact with ground when swung by the golfer, with reference to a middle or zero position and showing in a half-integral or integral number of distance unit increments changes in grip height required for the contact point to coincide with the middle or zero position;

measuring a distance between the golfer's wrist and the ground in a vertical direction and selecting one test club from the group of test clubs according to the measurement;

causing the golfer to hit a few shots on a hitting board using said one test club, whereby the stencil on the selected test club shows a contact point or contact-line with the hitting board relative to the middle of the sole;

taking a reading from the stencil on said one test club;

referring to a chart to determine how long the club shaft should be, taking into consideration a correction determined from the stencil, and then cutting a shaft for a new club with the correct length to provide a new club with the same loft and lie angle as the one test club; and placing a grip on an upper end of the shaft.

2. A method according to claim 1, wherein the stencil includes indicia that correspond to a shift of the contact line on the sole of the clubhead with respect to the middle or zero position of a club in terms of the grip height in half-integral or integral number increments of length units.

3. A method according to claim 1, wherein additional clubs for the golfer are made using shaft lengths for respective clubheads determined by reference to said chart.

* * * * *